US005909961A

United States Patent [19]

Pullman

[11] Patent Number: 5,909,961

[45] Date of Patent: Jun. 8, 1999

[54] DITCH DIGGING APPARATUS

[76] Inventor: Raynie Pullman, R. R. 2, Box 20, Wolsey, S. Dak. 57384

[21] Appl. No.: 08/980,800

[22] Filed: Dec. 1, 1997

[51] Int. Cl.[6] ..... E02F 3/00

[52] U.S. Cl. ..... 37/444; 414/723

[58] Field of Search ..... 37/442, 443, 444, 37/341, 379, 390; 414/722, 723, 724, 685; 294/68.1, 68.22, 55

[56] References Cited

U.S. PATENT DOCUMENTS

| | | | |
|---|---|---|---|
| 293,261 | 2/1884 | Matcham | 37/444 |
| D. 335,883 | 5/1993 | Devaney | D15/32 |
| 382,127 | 3/1888 | Wyman | 37/398 X |
| 1,545,343 | 7/1925 | Crane | 414/722 X |
| 1,573,128 | 2/1926 | Baker | 37/398 |
| 2,325,336 | 7/1943 | Mikan | 37/398 |
| 2,468,220 | 4/1949 | McLendon | 414/685 |
| 3,352,038 | 11/1967 | Kalve | 37/398 |
| 4,321,762 | 3/1982 | Hemphill | 37/444 |
| 4,903,418 | 2/1990 | Loudon | 37/301 |
| 4,963,071 | 10/1990 | Larwin et al. | 414/723 |
| 5,353,531 | 10/1994 | Doucette | 37/444 |

*Primary Examiner*—Thomas B. Will
*Assistant Examiner*—Robert Pezzuto
*Attorney, Agent, or Firm*—David A. Lingbeck

[57] ABSTRACT

A ditch digging apparatus including a bucket having a bottom wall with a radius curvature for digging ditches deeper than four feet, a back wall, a pair of spaced-apart side wall, an open front, a pair of forwardly tilting bracket members and an elongated support member. This ditch digging apparatus is easily and conventionally mounted to a loader on a prime mover and is adapted to cut into the ground and form a ditch in one single longitudinal pass through the ground.

13 Claims, 4 Drawing Sheets

DITCH DIGGING APPARATUS

BACKGROUND OF THE INVENTION

This invention relates to a ditch digging apparatus which can be mounted as essentially a front end bucket to a prime mover for cutting, digging and forming ditches.

Ditches are generally formed along roads and even along fields to facilitate the runoff of water from the roads and the fields. Such ditches typically have round bottoms and have been conventionally cut using backhoes or other ditch digging apparatuses; wherein, such apparatuses generally include heavy equipment which has an adjustable boom with some sort of bucket attached at the end of the boom. The user extends the boom and uses the bucket to cut and dig the land where the ditch is to be formed. This process usually takes an inordinate amount of time and energy, because so much of the ground can be picked up each time with the bucket and dumped away from where the digging is being done.

One known prior art is a DITCHING PLOW, U.S. Pat. No. 63,952, issued on Apr. 16, 1867 and invented by H. B. Smawley and comprises a beam, a share, two cutters, channels, flanges for the cutters, a chute, and guards. The share plows through the ground with the cutters cutting the ground as the plow moves with the ground being passed through the channel and out the chute.

Another known prior art an EXCAVATION BUCKET, U.S. Pat. No. 5,416,990, issued on May 23, 1995 and invented by William C. Otwell and comprises a bottom assembly which defines a scoop slot opening along a portion of the bottom assembly.

Yet, another known prior art is a DITCH DIGGING APPARATUS AND METHOD, U.S. Pat. No. 5,353,531, issued on Oct. 11, 1994 and invented by Rene P. Doucette and comprises a bucket having a top wall, bottom wall and a pair of side walls diverging forwardly from the rear wall to an open from end of the bucket, one of the side walls being planar and defining a sharp corner with the bottom wall, the other side wall having a curved bottom end whereby a round bottom ditch is formed by dragging the sharp corner through the ground in a first pass, and then making a second pass through the ground using the curved end of the bucket.

None of the prior art allows the user to quickly and conveniently cut and form a ditch by making one pass longitudinally through the ground and without having to bring out the heaving equipment such as described in the Doucette patent.

SUMMARY OF THE INVENTION

The present invention relates to a ditch digging apparatus which includes a bucket having a back wall, a pair of side walls, a bottom wall having a radius curvature, and a means for mounting to a prime mover.

One objective of the present invention is to provide a ditch digging apparatus which not only cuts into the ground but also forms the ditch at the same time as it makes one pass through a proposed ditch area of the ground.

Another objective of the present invention is to provide a ditch digging apparatus which essentially reduces the amount of time it takes to make a ditch by as much as one half.

Yet, another objective of the present invention is to provide a ditch digging apparatus which eliminates the need to bring out the heavy equipment to dig and form a ditch.

Further objectives and advantages of the present invention will become apparent as the description proceeds and when taken in conjunction with the accompanying drawings wherein:

DETAILED DESCRIPTION OF THE INVENTION

Figure 1:
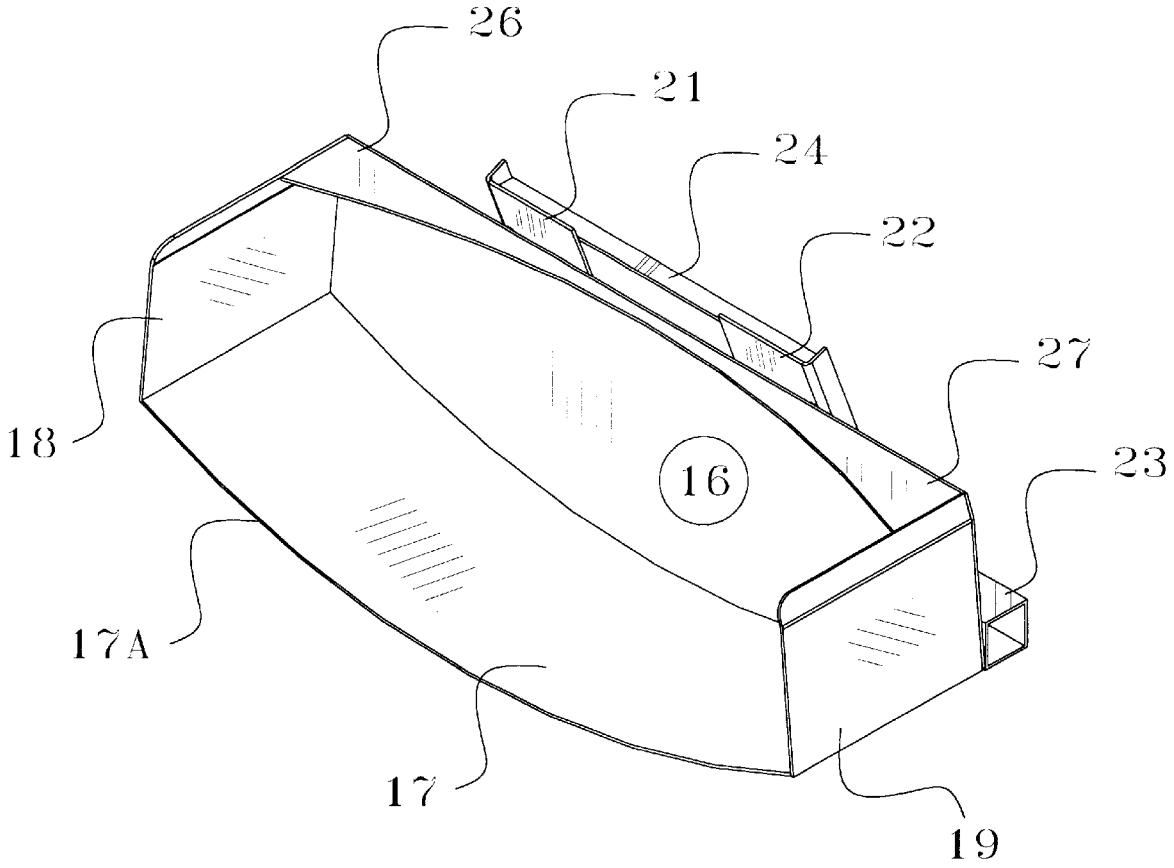
FIG. 1 is a top frontal perspective view of the ditch digging apparatus.
Figure 2:
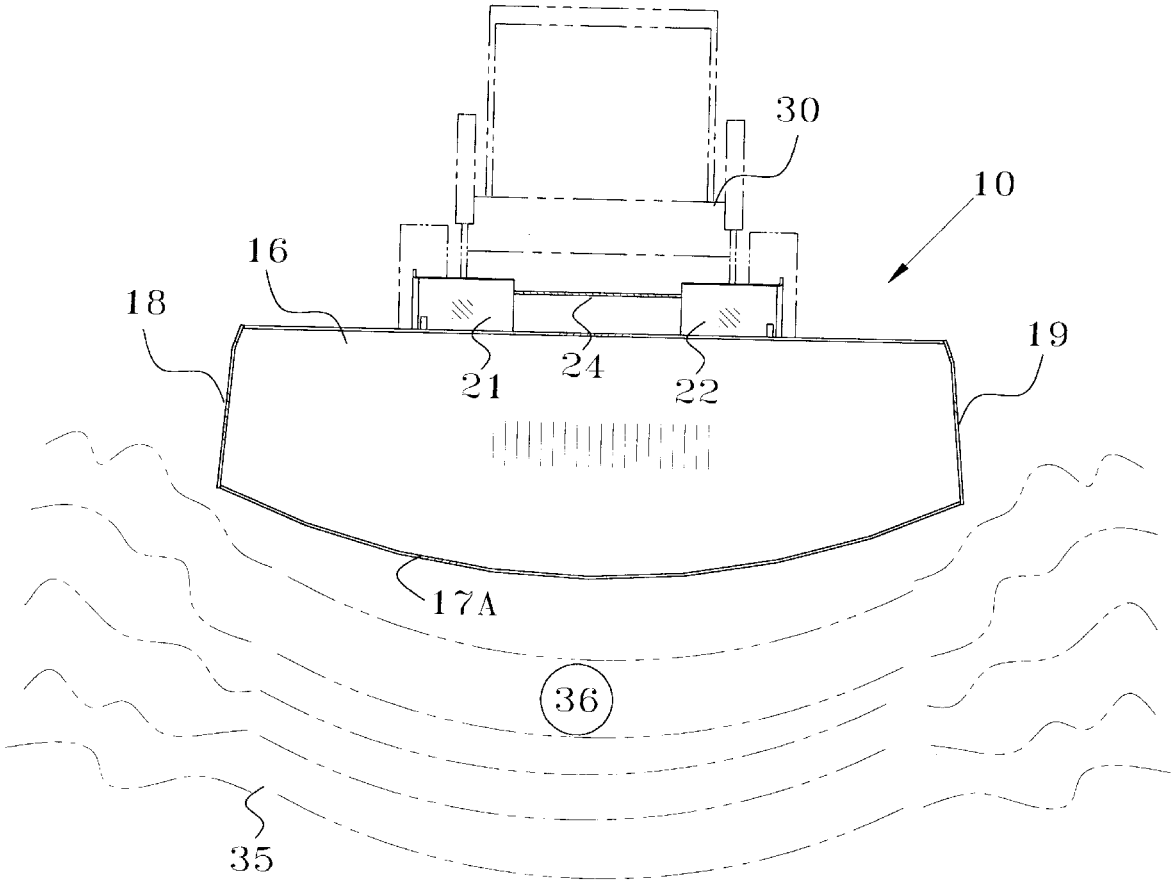
FIG. 2 is a front elevational view of the ditch digging apparatus mounted to a prime mover and being used to dig and form a ditch.
Figure 3:
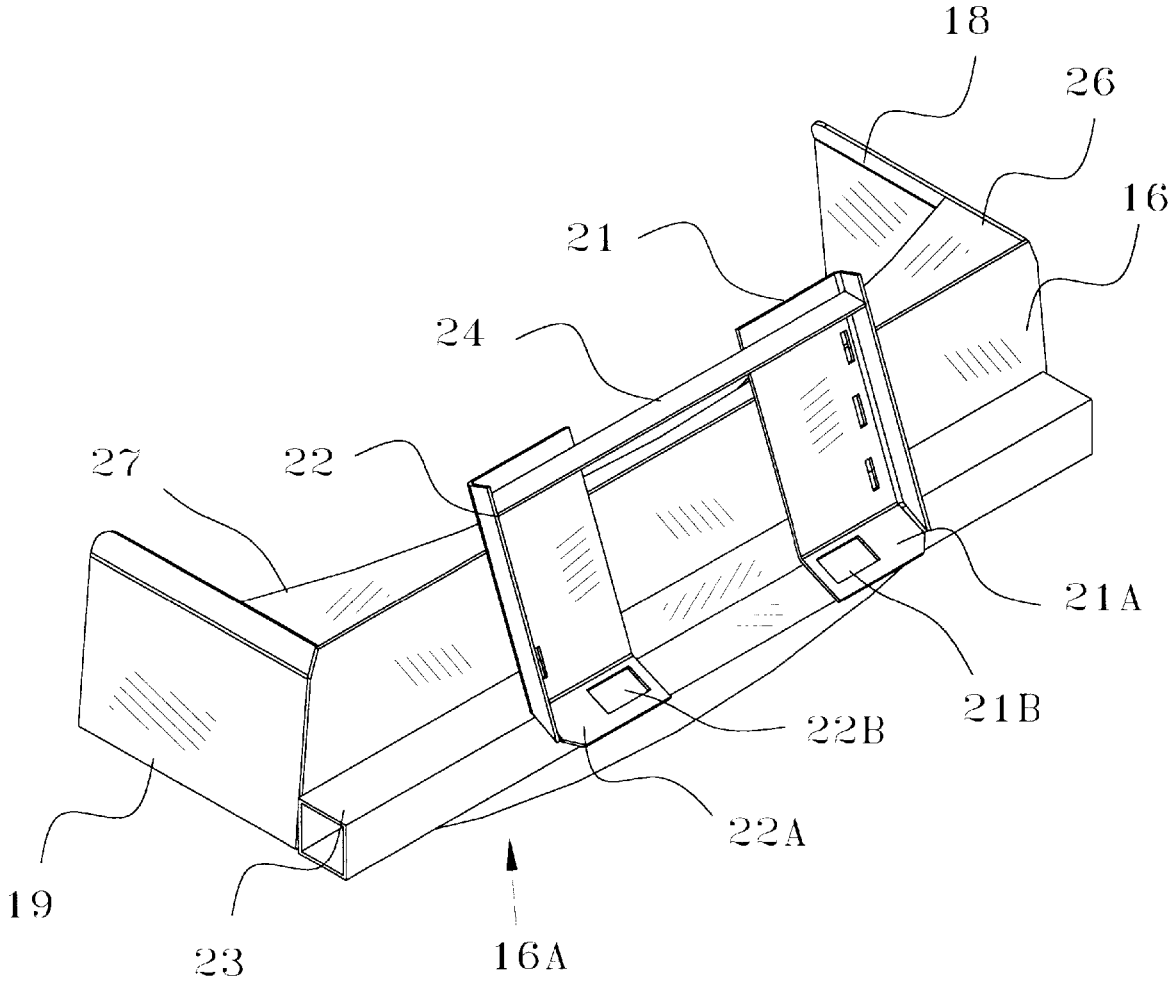
FIG. 3 is a top rear perspective view of the ditch digging apparatus.
Figure 4:
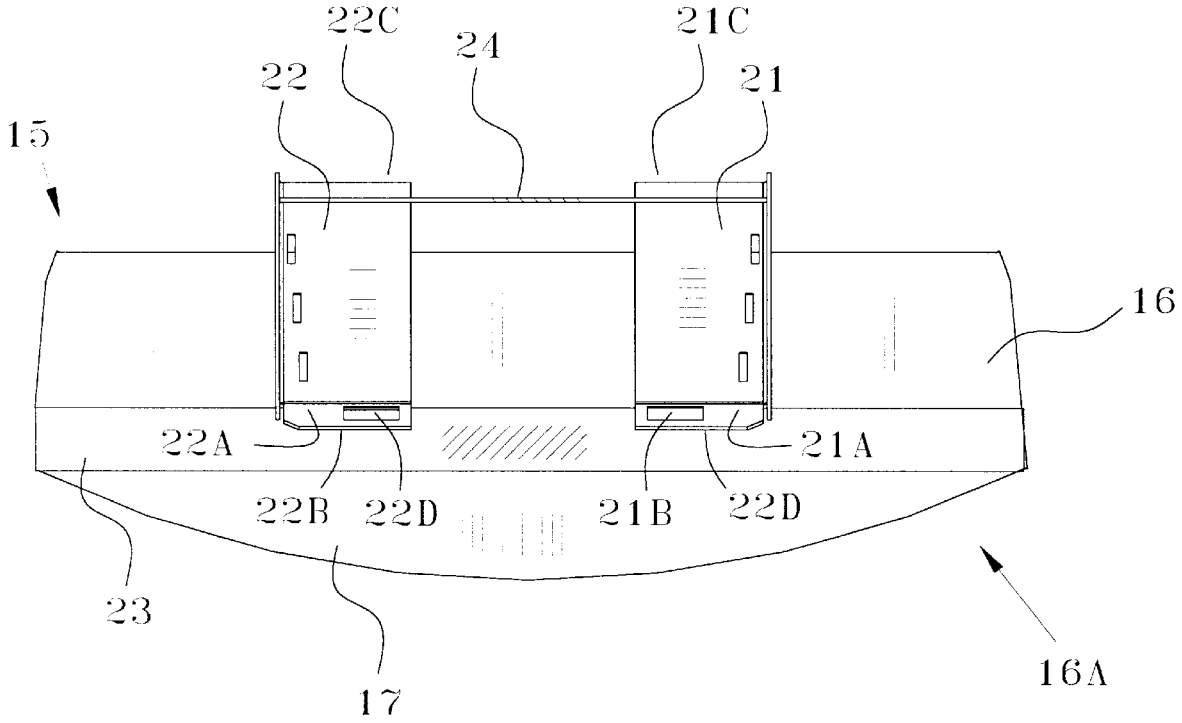
FIG. 4 is a rear elevational view of the ditch digging apparatus.

Referring to the drawings in FIGS. 1–4, in particular, the ditch digging apparatus 10 comprises a bucket 15 having a back wall 16 and a bottom wall 17 having an upward radius curvature relative to the ground 35 with the radius of curvature being longitudinal and being as much as 6.5 feet and as little as 2 feet and further being substantially symmetrical to facilitate the making of round bottom ditches, and further having a pair of spaced-apart side walls 18,19 diverging downward to the bottom wall 17, an open front 20, and means for mounting the bucket 15 to a prime mover or utility vehicle 30 which includes an elongate support member 23 which is generally tubular and which is conventionally attached on the exterior of the back wall 16 near the bottom 16A thereof and extending substantially the length of the back wall 16 and being disposed generally parallel to the bottom 16A of the back wall 16, and also includes a pair of spaced-apart angled bracket members 21,22 conventionally attached to the exterior of the back wall 16 and to the elongate support member 23 and each having a lower portion 21A,22A angled generally perpendicular thereto and generally parallel to the elongate support member 23. Each of the angled lower portions 21A,22A has a hole 21B,22B therethrough for conventionally mounting the ditch digging apparatus 10 to the loader of the prime mover or utility vehicle 30. The bracket members 21,22 are angled relative to the back wall 16 with the top ends 21C,22C of the bracket members 21,22 being tilted forward relative to the bottom ends 21D,22D to essentially facilitate the forward tilting of the bucket 15 when being used to cut into the ground 35. A cross member 24 is connected to the two bracket members 21,22 and extends therebetween to provide added strength to the bracket members 21,22. In addition, the side walls 18,19 are strengthened with a pair of substantially flat brace members 26,27 being attached to the back wall 16 and to the side walls 18,19 at the top ends 21C,22C thereof.

In operation, the user mounts the ditch digging apparatus 10 to the loader of a prime mover or utility vehicle 30 and begins the ditch digging process by lowering and tilting forward the bucket 15 to the ground 35 where the ditch 36 is to be made and uses the utility vehicle 30 to push the bucket 15 forward through the ground 35; whereupon the longitudinal front edge 17A of the bottom wall 17 cuts and digs into the ground 35 as the bucket 15 is urged forwardly through the ground 35 and essentially forms a round bottom ditch 36 like that of the curvature of the bottom wall 17. Unlike the prior art, this ditch digging apparatus 10 cuts and forms a ditch 36 in the same single longitudinal pass through the ground 35 and essentially reduces the amount of time to create a ditch 36 by as much as one half; wherein the prior art such as the DITCH DIGGING APPARATUS AND METHOD, U.S. Pat. No. 5,353,531 cuts and digs into the ground 35 in a first pass through the ground 35 and then forms the ditch in a second pass with another end of the bucket 15. Depending upon the radius of curvature of the bottom wall 17, this ditch digging apparatus 10 can make a ditch 36 deeper than four feet. As described above, this ditch digging apparatus 10 eliminates the need to use larger and heavier equipment such as backhoes and cranes to make ditches. The width of the bucket 15 can be as wide as eight feet with the width of the bottom wall 17 being approximately two feet wide and the height of the bucket 15 being approximately two feet high.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A ditch digging apparatus comprising:

a bucket having a back wall, a bottom wall having an upward radius curvature relative to a ground, a pair of spaced-apart side walls, an open front, and a means for mounting said bucket to a prime mover for cutting and forming a ditch in a single pass through a ground.

2. A ditch digging apparatus as described in claim 1, wherein said bottom wall has a longitudinal curvature.

3. A ditch digging apparatus as described in claim 2, wherein said bottom wall has a radius curvature of not less than two feet and not more than 6.5 feet.

4. A ditch digging apparatus as described in claim 3, wherein said bottom wall has a front longitudinal edge adapted to cut into the ground for making a ditch.

5. A ditch digging apparatus as described in claim 4, wherein said bottom wall is substantially symmetrically curved to facilitate forming a round bottom ditch.

6. A ditch digging apparatus as described in claim 5, wherein said bottom wall is structured to dig a ditch deeper than four feet.

7. A ditch digging apparatus as described in claim 1, wherein said side walls are diverging downward to said bottom wall.

8. A ditch digging apparatus as described in claim 1, wherein said means for mounting said bucket to a prime mover includes an elongate support member, a pair of angled bracket members, and a cross member.

9. A ditch digging apparatus as described in claim 1, wherein said elongate support member is attached near a bottom of said back wall and extends substantially the length of said back wall.

10. A ditch digging apparatus as described in claim 9, wherein said elongate support member is tubular and is disposed generally parallel to a bottom of said back wall.

11. A ditch digging apparatus as described in claim 1, wherein said pair of bracket members are spaced apart and are angled relative to said back wall to facilitate forward tilting of said bucket when being used to cut into a ground.

12. A ditch digging apparatus as described in claim 1, wherein each of said bracket members has a top end and a bottom end, said top end being tilted forward relative to said bottom end to facilitate forward tilting of said bucket when being used.

13. A ditch digging apparatus as described in claim 12, wherein each of said bracket members further has an angled bottom portion which has a hole therethrough to facilitate mounting said bucket to a prime mover.

* * * * *